US006227429B1

(12) United States Patent
Huang

(10) Patent No.: US 6,227,429 B1
(45) **Date of Patent: *May 8, 2001**

(54) STAPLER HAVING A BELT GUIDING MECHANISM

(76) Inventor: Shih Chang Huang, No. 134, Yiau San Street, San Min Chu, Kaoshiung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/475,742

(22) Filed: Dec. 30, 1999

Related U.S. Application Data

(63) Continuation-in-part of application No. 09/376,392, filed on Aug. 18, 1999.

(51) Int. Cl.[7] ..... B28B 23/04

(52) U.S. Cl. ..... 227/119; 227/120; 227/136; 227/142; 81/57.37; 81/434

(58) Field of Search ..... 227/119, 120, 227/135, 136, 142, 109; 81/434, 435, 57.37

(56) References Cited

U.S. PATENT DOCUMENTS

| | | | | |
|---|---|---|---|---|
| 3,757,407 | * | 9/1973 | Bomar | 81/57.37 |
| 3,891,014 | * | 6/1975 | Gunn | 81/57.37 |
| 3,920,169 | * | 11/1975 | DeCaro | 227/136 |
| 4,404,877 | * | 9/1983 | Mizuno et al. | 227/136 |
| 5,101,697 | * | 4/1992 | Fishback | 81/434 |
| 5,231,900 | * | 8/1993 | Deri | 81/57.37 |
| 5,284,074 | * | 2/1994 | Chen | 81/434 |
| 5,826,468 | * | 10/1998 | Daubinger et al. | 81/434 |
| 5,975,350 | * | 11/1999 | Han | 227/120 |
| 6,123,244 | * | 9/2000 | Huang | 227/119 |

* cited by examiner

*Primary Examiner*—Scott A. Smith
(74) *Attorney, Agent, or Firm*—Charles E. Baxley

(57) ABSTRACT

A stapler includes a barrel slidably received in a housing for engaging with a work piece, and a base having one end adjustably secured to the barrel and having a groove for slidably receiving fasteners. A casing is slidably engaged onto the base, a pusher is pivotally coupled to the casing, and a spring biases the pusher to the casing and biases the casing and the pusher toward the barrel for moving the fasteners into the barrel one by one. The casing and the pusher may be moved away from the barrel by a cam surface when the barrel is moved inward of the housing against a spring.

12 Claims, 9 Drawing Sheets

STAPLER HAVING A BELT GUIDING MECHANISM

The present invention is a continuation-in-part of U.S. patent application Ser. No. 09/376,392, filed Aug. 18, 1999, pending.

BACKGROUND OF THE INVENTION

1. Field of the Invention

The present invention relates to a stapler, and more particularly to a stapler having a guiding mechanism for guiding the belt that holds the fasteners or the nails to be driven into the work pieces.

2. Description of the Prior Art

Typical staplers comprise a driving member for driving the fasteners or the nails supported in line in a belt. The belt is moved into the stapler step by step for supplying the fasteners into the stapler. However, the stapler has no guiding mechanism for guiding the belt through the stapler such that the belt may not be stably retained in place and may move here and there.

The present invention has arisen to mitigate and/or obviate the afore-described disadvantages of the conventional staplers.

SUMMARY OF THE INVENTION

The primary objective of the present invention is to provide a stapler having a guiding mechanism for guiding the belt and the fasteners into the stapler.

In accordance with one aspect of the invention, there is provided a stapler comprising a housing secured to a body and including a chamber formed therein, the body including a driving tool extended therefrom and rotatably received in the chamber of the housing, a barrel slidably received in the chamber of the housing for engaging with a work piece, a base including a first end secured to the barrel and including an orifice formed in the first end of the base and aligned with the driving tool for allowing the driving tool to be engaged through the orifice of the base, the base including a groove formed therein for slidably receiving fasteners to be engaged into the work piece, a latch engaged into the barrel and engaged with the first end of the base for securing the first end of the base to the barrel, the latch including a pair of protrusion extended therefrom and a slit defined between the protrusions of the latch for slidably receiving and guiding the fasteners, a casing including a space formed therein for slidably receiving the base and for slidably engaging the casing onto the base, the casing including a passageway formed therein for slidably receiving the fasteners, means for moving the fasteners into the barrel, and a biasing means received in the chamber of the housing and engaged with the barrel and the base for applying a biasing force against the barrel and the base when the barrel and the first end of the base are forced inward of the housing.

An adjusting device is further provided for adjustably securing the first end of the base to the barrel and includes a plurality pairs of notches formed in the barrel, and the latch is engaged into the barrel via the notches and engaged with the first end of the base for securing the first end of the base to the barrel. The first end of the base includes at least one recess formed therein, the latch includes at least one hook engaged into the recess of the base and engaged with the base for securing the latch to the base and to the barrel. The latch includes a passage formed therein for slidably receiving the fasteners, the stapler further includes a belt for supporting the fasteners, and the latch includes a frame to define the passage of the latch for slidably engaging with and guiding the belt.

A guiding device is further provided for guiding the barrel and the first end of the base to slide in the chamber of the housing and includes a block secured to the first end of the base, at least one groove formed in the housing, at least one slot formed in the barrel, and at least one fastener engaged through the groove of the housing and the slot of the barrel and engaged with the block for slidably securing the block and the barrel to the housing. One or more slides are slidably engaged through the groove of the housing and the slot of the barrel, the fastener is engaged through the slide and engaged with the block for slidably securing the block and the barrel to the housing.

The fasteners moving means includes a pusher pivotally secured to the casing at a pivot pole and having an extension for engaging with the fastener, and means for biasing the pusher to the casing and to engage with the fasteners. The casing includes a duct formed therein, the pivot pole is extended from the pusher and rotatably secured in the duct for pivotally securing the pusher to the casing.

A moving device is further provided for moving the casing away from the barrel when the barrel moves inward of the housing and includes at least one cam surface formed in the housing, the casing includes a rod engaged with the cam surface for moving the casing away from the barrel when the barrel moves inward of the housing. A securing device is further provided for securing the rod to the casing. A block is secured to the first end of the base and includes an arm having a groove for slidably receiving a coupler.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 3:
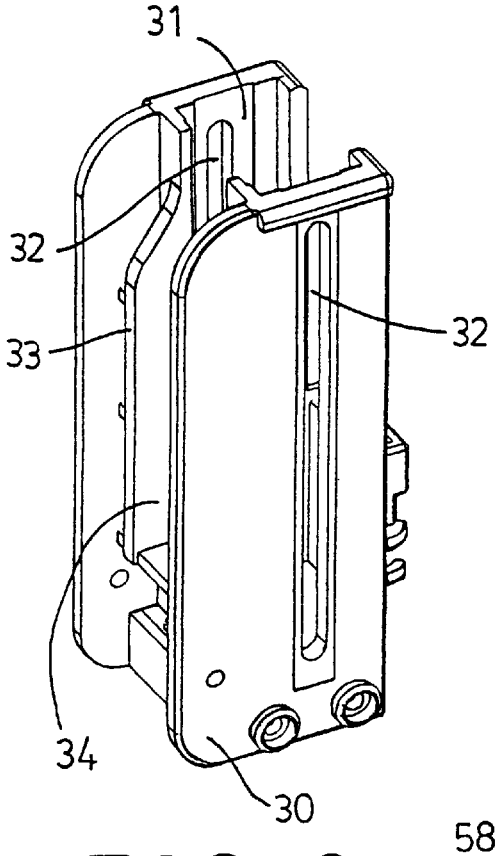
FIG. 3 is a perspective view of a housing of the belt guiding mechanism.

Referring to the drawings, and initially to FIGS. 1–4, a stapler in accordance with the present invention comprises a power tool body 10 including a housing 30 secured thereto and including a driving tool 11 rotatably received in the housing 30. The housing 30 includes a chamber 31 formed therein and includes one or both sides each having a groove 32 formed therein and includes a channel 34 formed therein and communicating with the chamber 31 of the housing 30. The housing 30 includes one or more cam surfaces 33 formed therein (FIG. 3). A barrel 40 is slidably received in the chamber 31 of the housing 30 and includes one or more pairs of notches 42 formed therein and includes one or both sides each having a slot 43 formed therein and aligned with the grooves 32 of the housing 30 respectively. The barrel 40 includes an outlet 41 aligned with the driving tool 11 which may drive the fasteners 21 through the outlet 41 of the barrel 40 (FIG. 13) when the barrel 40 is forced inward of the housing 30. A spring 90 (FIG. 13) is received in the housing 30 and engaged on the driving tool 11.

Figure 5:
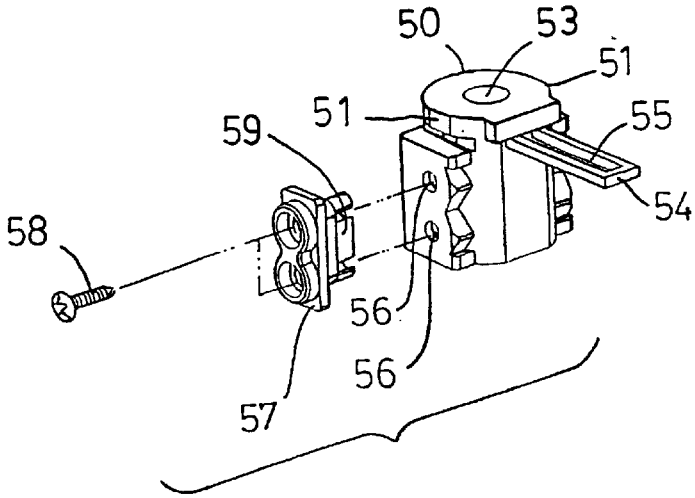
FIG. 5 is an exploded view of a block and the fastener of the belt guiding mechanism.
Figure 13:
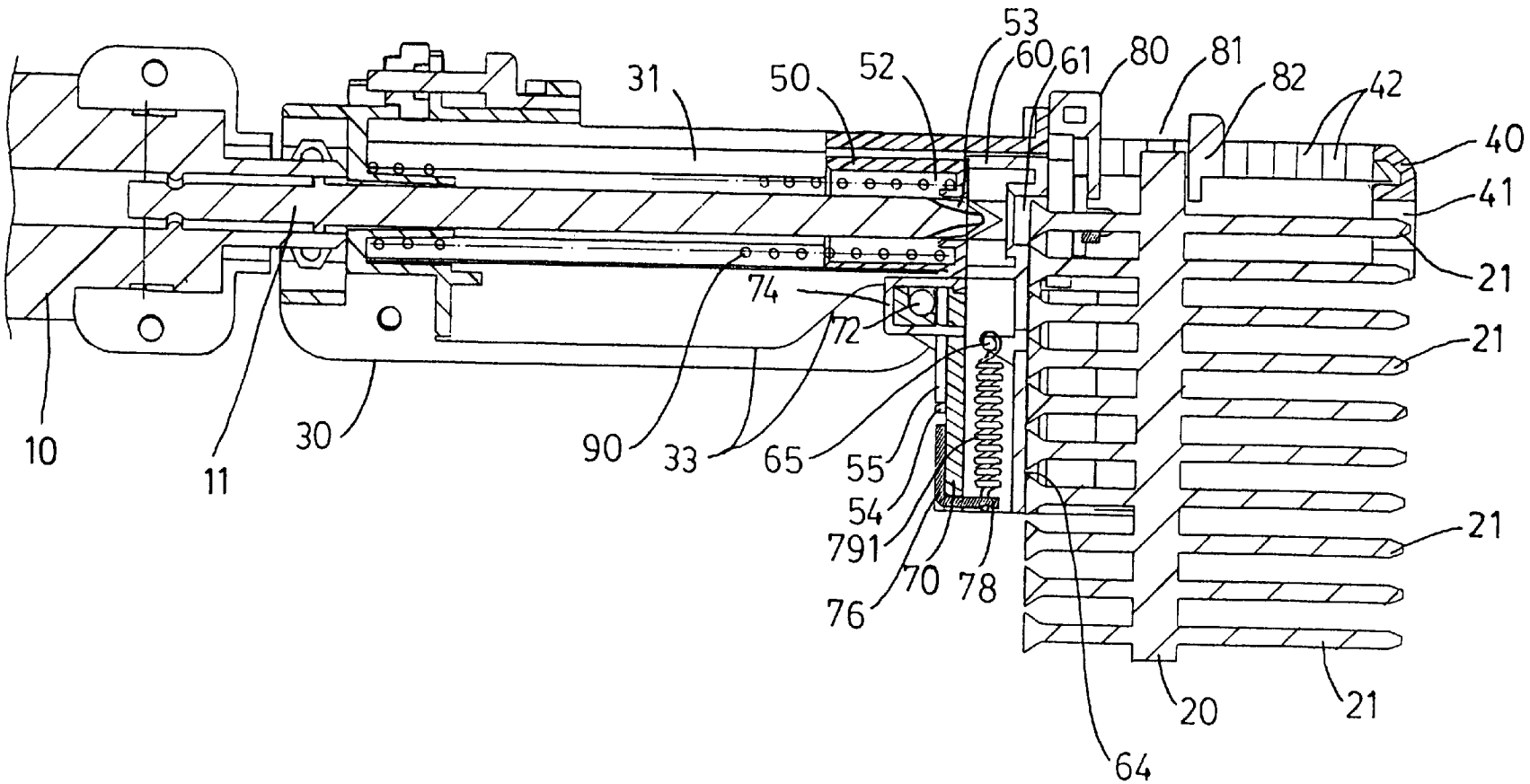

A block 50 is slidably received in the barrel 40 and includes one or more screw holes 56 formed therein. One or two slides 57 each includes a projection 59 slidably engaged in the respective groove 32 of the housing 30 and the slot 43 of the barrel 40, and each includes one or more fasteners 58 (FIG. 5) engaged through the slide 57 and engaged with the screw holes 56 of the block 50 for slidably securing the barrel 40 and the block 50 to the housing 30 and for limiting the sliding movement of the barrel 40 and the block 50 relative to the housing 30. The block 50 includes a chamber 52 (FIGS. 11, 13) formed therein for receiving the spring 90 and includes an upper disc 51 formed on top thereof and includes a bore 53 formed therein and aligned with the driving tool 11 for slidably receiving the driving tool 11 (FIG. 13). The block 50 includes an arm 54 extended from the upper portion thereof and having a groove 55 formed therein. The arm 54 is extended outward of the barrel 40 from an open side 44 of the barrel 40.

Figure 6:
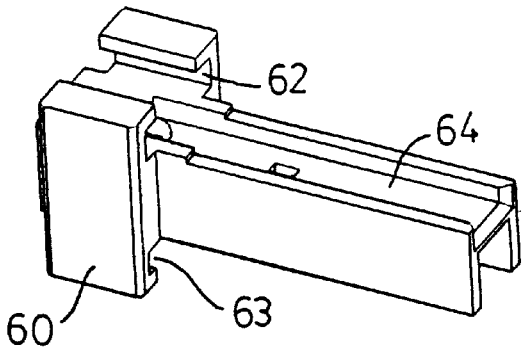
FIG. 6 is a perspective view of a base of the belt guiding mechanism.
Figure 7:
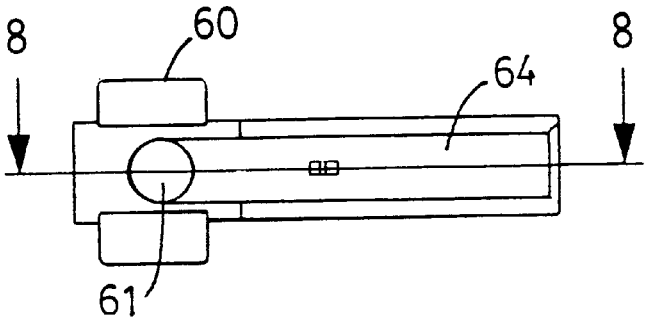
FIG. 7 is a top view of the base of the belt guiding mechanism.
Figure 8:
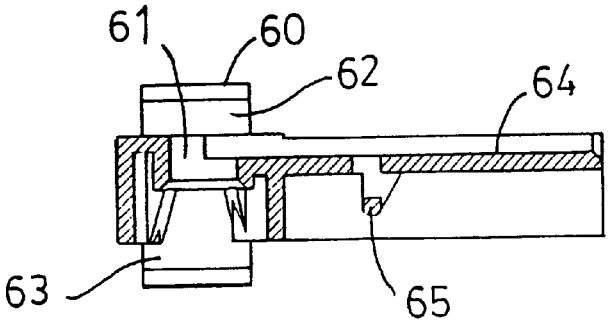
FIG. 8 is a cross sectional view taken along lines 8—8 of FIG. 7.

A base 60 (FIGS. 6–8) includes a first end engaged into the barrel 40 from the open side 44 of the barrel 40 and slidably received in the barrel 40 and having a channel 63 formed therein for receiving the disc 51 of the block 50 and for allowing the first end of the base 60 to be secured to the block 50 and to be moved in the barrel 40 in concert with the block 50. The base 60 includes an orifice 61 (FIGS. 7, 8, 11) formed therein and aligned with the bore 53 of the block 50 for slidably receiving the driving tool 11. The base 60 includes a groove 64 formed in the upper portion thereof and communicating with the orifice 61 of the base 60 for receiving and for guiding the belt 20 (FIG. 13) and the heads of the fasteners 21 into the orifice 61 of the base 60. The fasteners 21 are releasably secured on the belt 20. The groove 64 preferably includes a size substantially equals to that of the belt 20 and the fasteners 21 for stably guiding the belt 20 and the fasteners 21 into the barrel 40.

Figure 16:
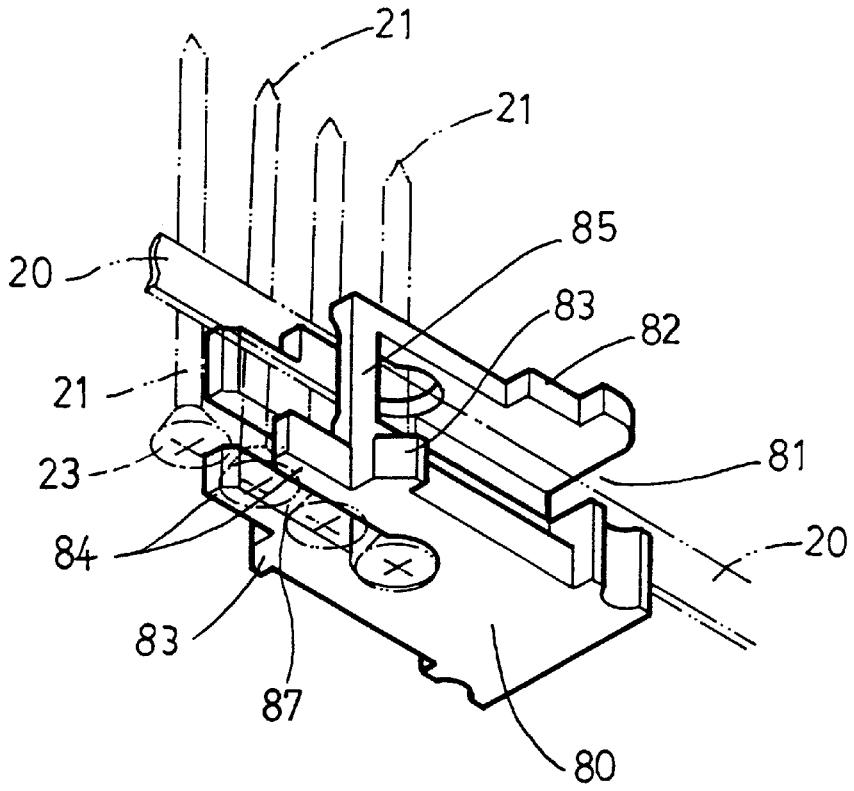
FIGS. 15, 16 are perspective views illustrating the operation of the latch.
Figure 15:
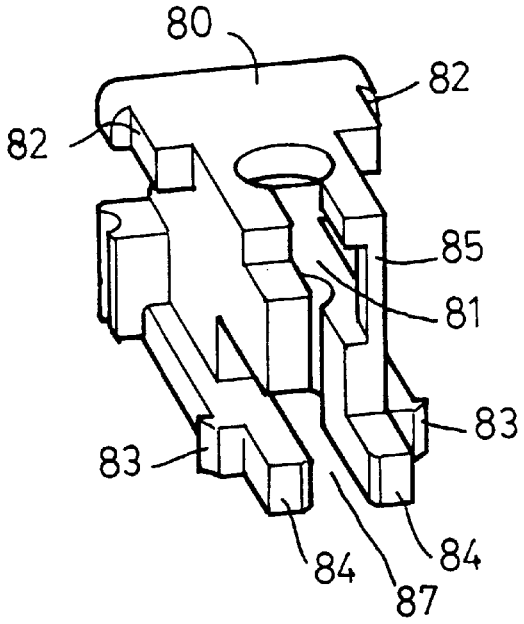

A latch 80 has one or more hooks 83 engaged into the barrel 40 and engaged through the recesses 62 formed in the base 60 and hooked to the base 60 for securing the base 60 and the block 50 to the barrel 40, such that the barrel 40 and the block 50 and the base 60 and the latch 80 are secured together and are slidable in concert in the chamber 31 of the housing 30. The spring 90 is engaged with the block 50 for applying a biasing force against the barrel 40 when the block 50 and the barrel 40 are forced inward of the housing 30. The latch 80 includes an ear 82 formed thereon and engaged into either pairs of the notches 42 of the barrel 40 for securing the latch 80 to the barrel 40. The latch 80 includes a passage 81 formed therein for receiving and guiding the belt 20 (FIGS. 15, 16). The ear 82 of the latch 80 may be used to engage with and to guide the belt 20 for allowing the belt 20 to be moved smoothly through the passage 81 of the latch 80. The ear 82 of the latch 80 may be selectively engaged with either pair of the notches 42 of the barrel 40 for adjusting the distance between the orifice 61 of the base 60 and the outlet 41 of the barrel 40 which preferably corresponds to the length of the fasteners 21 (FIG. 13).

The latch 80 includes a bottom portion having a slit 87 formed therein (FIGS. 15, 16) and defined between a pair of protrusions 84 for slidably receiving the fasteners 21 (FIG. 16). The slit 87 of the latch 80 has a size equals to the fasteners 21 such that the heads 23 (FIG. 16) of the fasteners 21 may be engaged with the protrusions 84 and such that the fasteners 21 may be guided to move in a line and may be prevented from moving laterally relative to the latch 80, such that the fasteners 21 may be precisely guided and fed into the barrel 40 and to be driven by the driving tool 11. The latch 80 further includes a wall or a frame 85 (FIGS. 15, 16) formed therein for defining the passage 81 thereof and for engaging with the belt 20 (FIG. 16) in order to smoothly and precisely guide the belt 20 to move through the latch 80 and in order to prevent the belt 20 from moving laterally relative to the latch 80 when the fasteners 21 are driven out or through the belt 20 by the driving tool 11.

Figure 1:
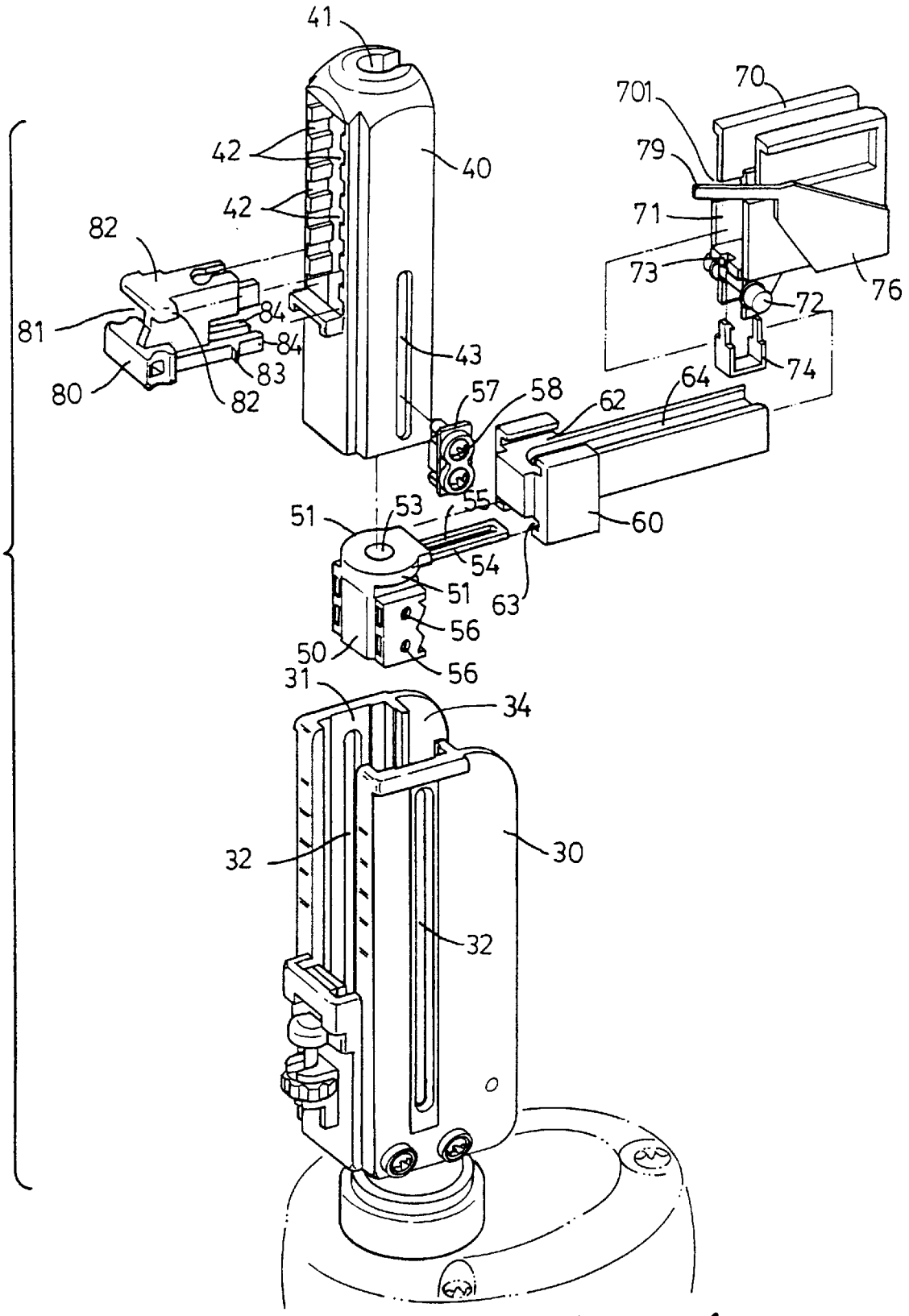
FIG. 1 is an exploded view of a stapler having a belt guiding mechanism.
Figure 2:
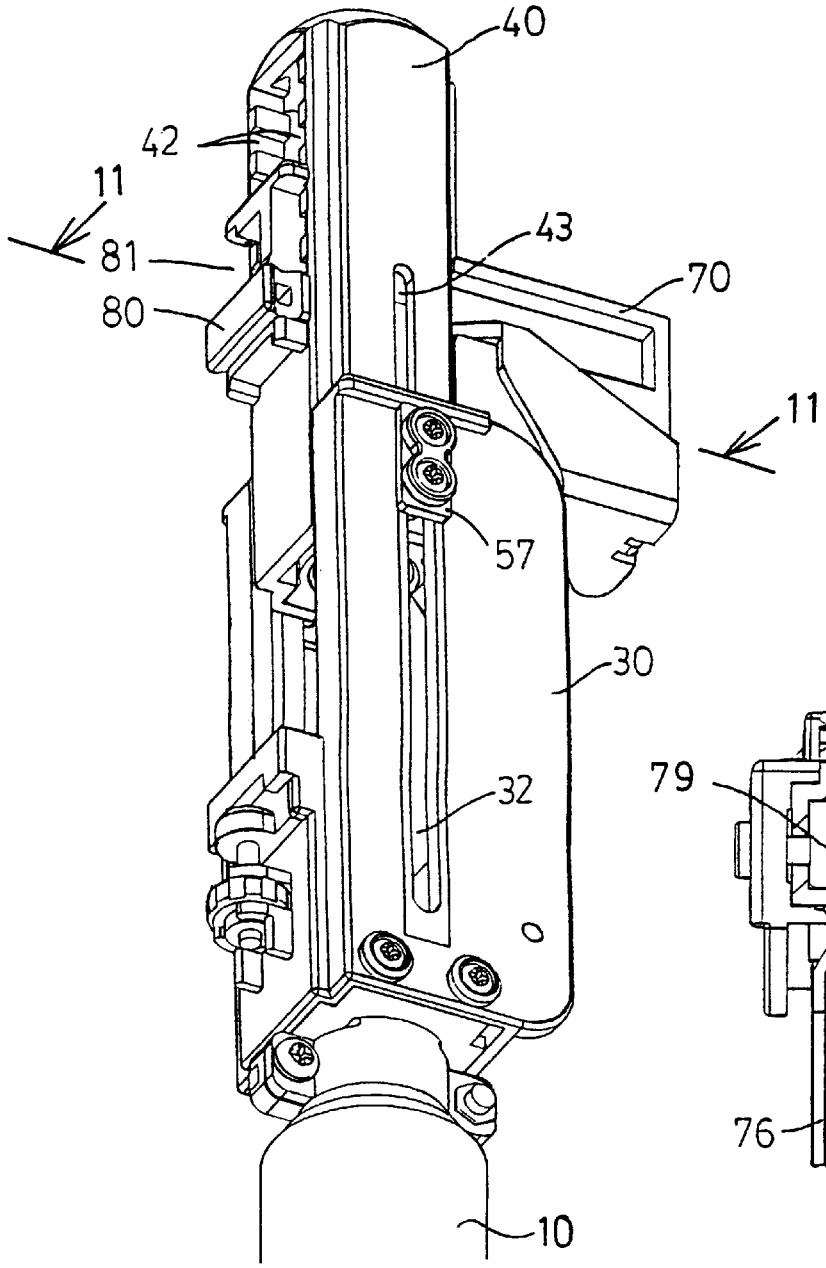
FIG. 2 is a perspective view of the belt guiding mechanism of the stapler.
Figure 14:
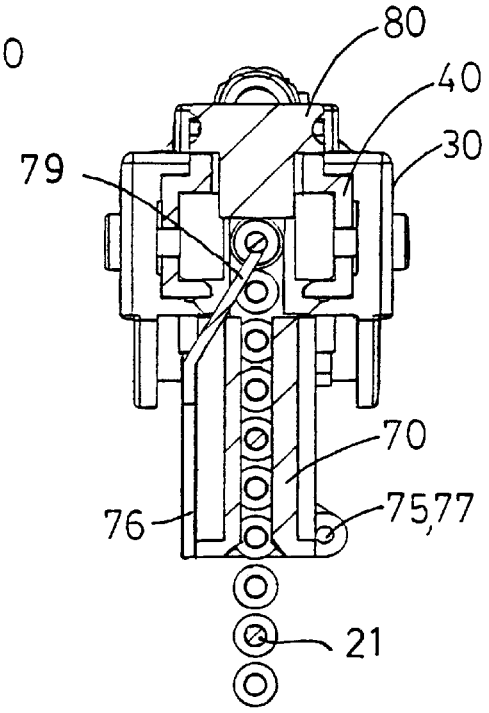
FIGS. 13, 14 are cross sectional views taken along lines 13—13 and 14—14 of FIG. 12 respectively.
Figure 4:
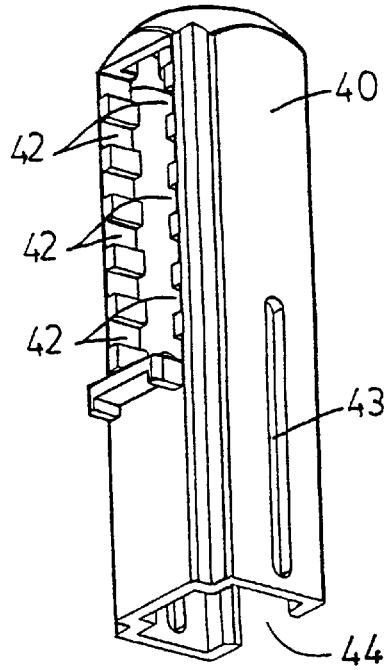
FIG. 4 is a perspective view of a barrel of the belt guiding mechanism.
Figure 9:
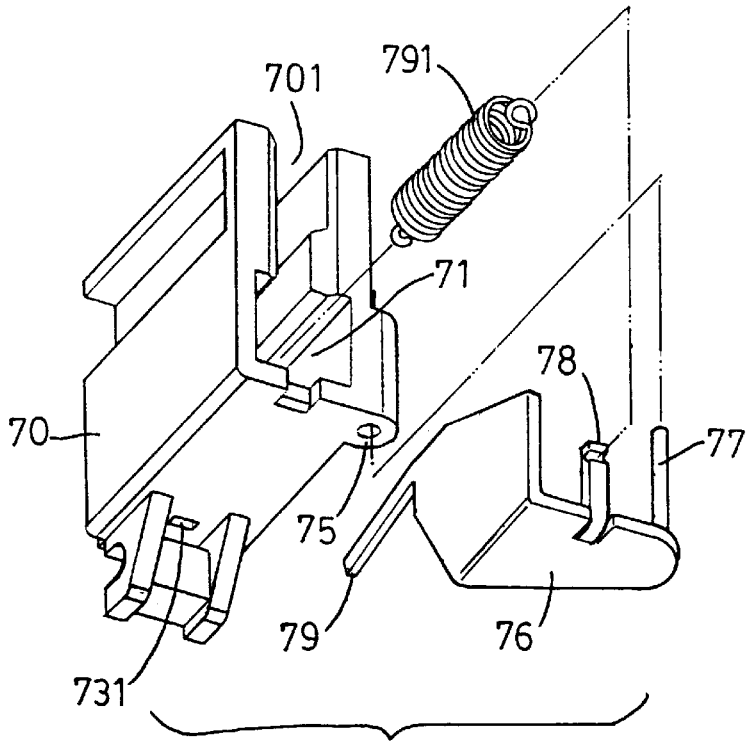
FIG. 9 is an exploded view of a casing and a pusher of the belt guiding mechanism.
Figure 10:
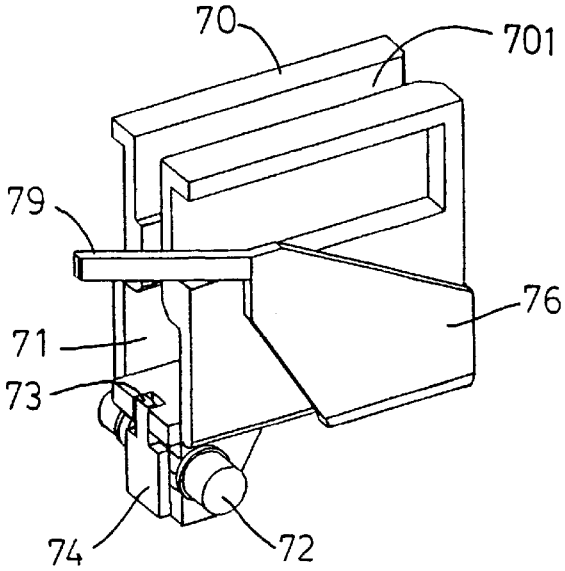
FIG. 10 is a perspective view of the casing and the pusher of the belt guiding mechanism.
Figure 11:
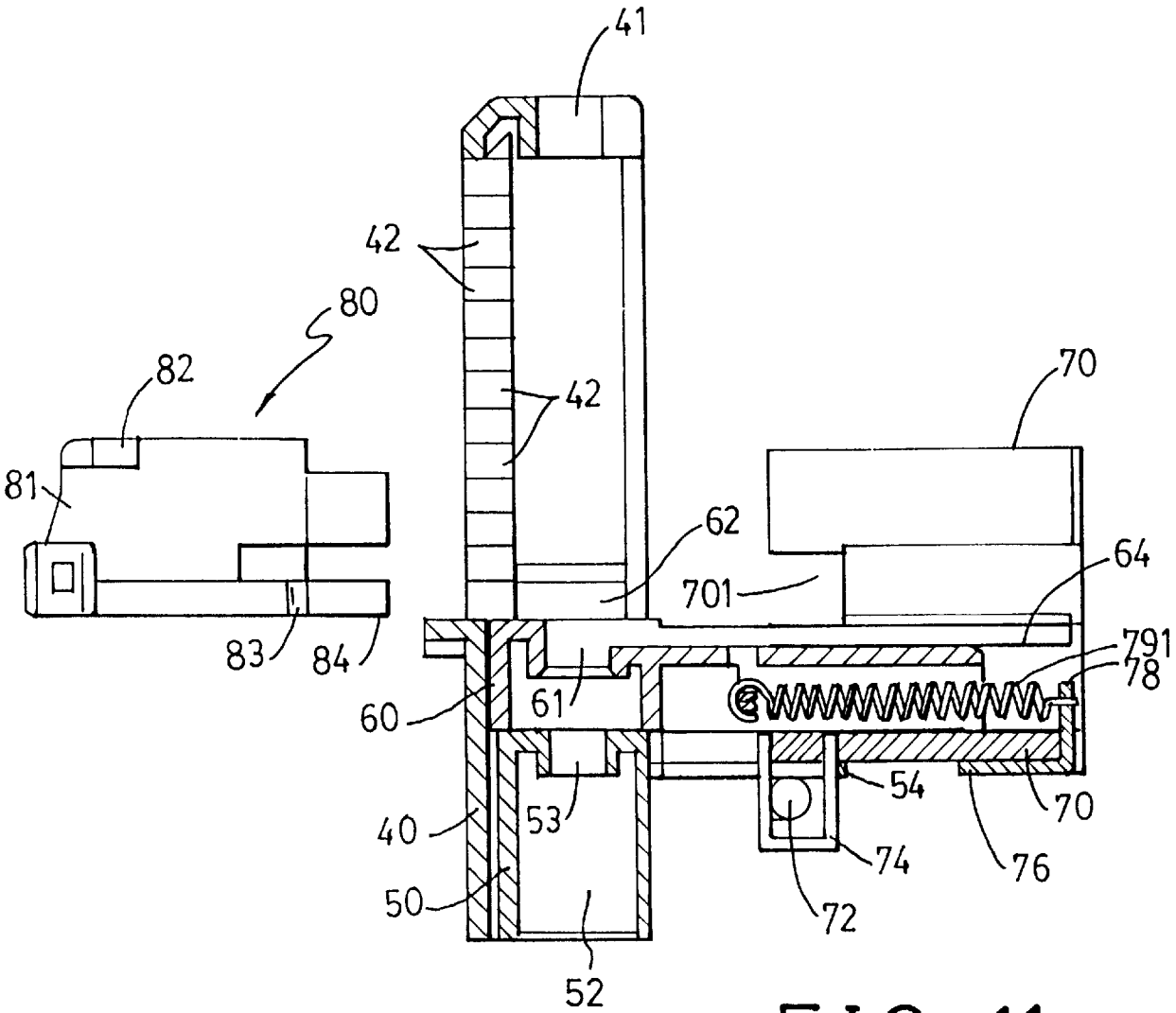
FIG. 11 is a cross sectional view taken along lines 11—11 of FIG. 2.

As shown in FIGS. 9–11, a casing 70 includes a space 71 formed therein for slidably receiving the base 60 and for allowing the casing 70 to be slidably engaged onto the base 60. The casing 70 includes A rod 72 is secured to the casing 70 with a coupler 74 which includes two hooks engaged through the apertures 73, 731 of the casing 70 and engaged with the casing 70 for rotatably securing the rod 72 to the casing 70. The coupler 74 is slidably engaged in the groove 55 of the arm 54 of the block 50 for guiding and limiting the casing 70 to move relative to the block 50 and thus the base 60. The casing 70 includes a passageway 701 formed therein for slidably receiving the belt 20. A pusher 76 has a pole 77 rotatably received in a duct 75 of the casing 70 for pivotally securing the pusher 76 to the casing 70 and for allowing the pusher 76 to be rotated relative to the casing 70 about the pole 77. The pusher 76 includes an extension 79 extended therefrom for engaging with and for moving the fasteners 21 and the belt 20 forward (FIG. 14). A spring 791 has one end secured to a stud 65 of the base 60 and has the other end secured to a pole 78 of the casing 70 for moving the casing 70 and the pusher 76 toward the barrel 40 (FIGS. 11, 13) and for moving the fasteners 21 of the belt 20 inward of the barrel 40 (FIG. 14). The rod 72 may be used to slidably engage with the cam surfaces 33 of the housing 30 (FIG. 13) to move the casing 70 and the pusher 76 away from the barrel 40 when the base 60 and the barrel 40 are forced inward of the housing 30 against the spring 90.

Figure 12:
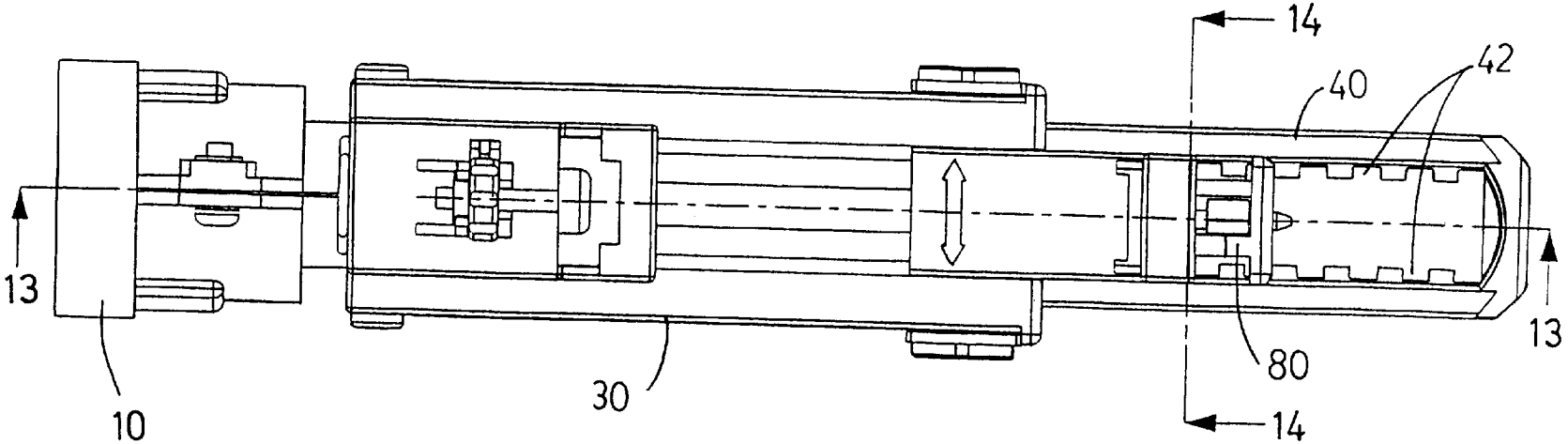
FIG. 12 is a plane view of the belt guiding mechanism of the stapler, in which the belt guiding mechanism and the stapler are rotated for 90 degrees and are disposed in a horizontal status.

In operation, as shown in FIGS. 12–14, the fasteners 21 may be pushed inward of the barrel 40 by the pusher 76 before the fasteners 21 may be driven into the work piece. When the barrel 40 is engaged with and forced against the work piece and when the driving tool 11 is actuated to drive the fastener 21 into the work piece, the base 60 and the casing 70 and the barrel 40 and the block 50 may be forced toward the body 10 against the spring 90 until the fastener 21 is driven into the work piece. When the casing 70 and the base 60 and the barrel 40 are forced toward the body 10 against the spring 90, the rod 72 of the casing 70 will be forced to move along the cam surfaces 33 of the housing 30 and to move the casing 70 and the pusher 76 away from the barrel 40 against the spring 791. At this moment, the pusher 76 may be forced to rotate about the pole 77 against the spring 791, and the extension 79 of the pusher 76 may then be moved to engage with the next fastener 21. When the fastener 21 has been driven into the work piece and when the barrel 40 is released, the spring 791 may bias the casing 70 and the pusher 76 toward the barrel 40 again so as to move the next fastener 21 into the barrel 40 and aligned with the orifice 61 of the base 60 and the bore 53 of the block 50. The pusher 76 may thus move the fasteners 21 into the barrel 40 one by one or step by step.

Accordingly, the stapler in accordance with the present invention includes a guiding mechanism for guiding the belt and the fasteners into the stapler.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stapler comprising:

a body, a housing secured to said body and including a chamber formed therein, said body including a driving tool extended therefrom and rotatably received in said chamber of said housing, a barrel slidably received in said chamber of said housing for engaging with a work piece, a base including a first end secured to said barrel and including an orifice formed in said first end of said base and aligned with said driving tool for allowing said driving tool to be engaged through said orifice of said base, said base including a groove formed therein for slidably receiving fasteners to be engaged into the work piece, a latch engaged into said barrel and engaged with said first end of said base for securing said first end of said base to said barrel, said latch including a pair of protrusions extended therefrom and a slit defined between said protrusions of said latch for slidably receiving and guiding the fasteners, said latch including a passage formed therein for slidably receiving the fasteners, said stapler further including a belt for supporting the fasteners, and said latch including a frame to define said passage of said latch for slidably engaging with and guiding the belt, a casing including a space formed therein for slidably receiving said base and for slidably engaging said casing onto said base, said casing including a passageway formed therein for slidably receiving the fasteners, means for moving the fasteners into said barrel, and a biasing means received in said chamber of said housing and engaged with said barrel and said base for applying a biasing force against said barrel and said base when said barrel and said first end of said base are forced inward of said housing.

2. The stapler according to claim 1 further comprising means for adjustably securing said first end of said base to said barrel, said adjustably securing means including a plurality pairs of notches formed in said barrel, and said latch being engaged into said barrel via said notches and engaged with said first end of said base for securing said first end of said base to said barrel.

3. The stapler according to claim 2, wherein said first end of said base includes at least one recess formed therein, said latch includes at least one hook engaged into said at least one recess of said base and engaged with said base for securing said latch to said base and to said barrel.

4. The stapler according to claim 1 further comprising means for guiding said barrel and said first end of said base to slide in said chamber of said housing.

5. The stapler according to claim 1, wherein said fasteners moving means includes a pusher pivotally secured to said casing at a pivot pole and having an extension for engaging with the fastener, and means for biasing said pusher to said casing and to engage with the fasteners.

6. The stapler according to claim 1 further comprising means for moving said casing away from said barrel when said barrel moves inward of said housing.

7. The stapler according to claim 6, wherein said casing moving means includes at least one cam surface formed in said housing, said casing includes a rod engaged with said cam surface for moving said casing away from said barrel when said barrel moves inward of said housing.

8. A stapler comprising:

a body, a housing secured to said body and including a chamber formed therein, said body including a driving tool extended therefrom and rotatable received in said chamber of said housing, a barrel slidably received in said chamber of said housing for engaging with a work piece, a base including a first end secured to said barrel and including an orifice formed in said first end of said base and aligned with said driving tool for allowing said driving tool to be engaged through said orifice of said base, said base including a groove formed therein for slidably receiving fasteners to be engaged into the work piece, a latch engaged into said barrel and engaged with said first end of said base for securing said first end of said base to said barrel, said latch including a pair of protrusions extended therefrom and a slit defined between said protrusions of said latch for slidably receiving and guiding the fasteners, a casing including a space formed therein for slidably receiving said base and for slidably engaging said casing onto said base, said casing including a passageway formed therein for slidably receiving the fasteners, means for moving the fasteners into said barrel, a biasing means received in said chamber of said housing and engaged with said barrel and said base for applying a biasing force against said barrel and said base when said barrel and said first end of said base are forced inward of said housing, and means for guiding said barrel and said first end of said base to slide in said chamber of said housing, said guiding means including a block secured to said first end of said base, at least one groove formed in said housing, at least one slot formed in said barrel, and at least one fastener engaged through said at least one groove of said housing and said at least one slot of said barrel and engaged with said block for slidably securing said block and said barrel to said housing.

9. The stapler according to claim 8 further comprising at least one slide slidably engaged through said at least one groove of said housing and said at least one slot of said barrel, said at least one fastener being engaged through said at least one slide and engaged with said block for slidably securing said block and said barrel to said housing.

10. A stapler comprising:

a body, a housing secured to said body and including a chamber formed therein, said body including a driving tool extended therefrom and rotatable received in said chamber of said housing, a barrel slidably received in said chamber of said housing for engaging with a work piece, a base including a first end secured to said barrel and including an orifice formed in said first end of said base and aligned with said driving tool for allowing said driving tool to be engaged through said orifice of said base, said base including a groove formed therein for slidably receiving fasteners to be engaged into the work piece, a latch engaged into said barrel and engaged with said first end of said base for securing said first end of said base to said barrel, said latch including a pair of protrusions extended therefrom and a slit defined between said protrusions of said latch for slidably receiving and guiding the fasteners, a casing including a space formed therein for slidably receiving said base and for slidably engaging said casing onto said base, said casing including a passageway formed therein for slidably receiving the fasteners, means for moving the fasteners into said barrel, said fasteners moving means including a pusher pivotally secured to said casing at a pivot pole and having an extension for engaging with the fastener, and means for biasing said pusher to said casing and to engage with the fasteners, and a biasing means received in said chamber of said housing and engaged with said barrel and said base for applying a biasing force against said barrel and said base when said barrel and said first end of said base are forced inward of said housing, wherein said casing includes a duct formed therein, said pivot pole is extended from said pusher and rotatably secured in said duct for pivotally securing said pusher to said casing.

11. A stapler comprising:

a body, a housing secured to said body and including a chamber formed therein, said body including a driving tool extended therefrom and rotatably received in said chamber of said housing, a barrel slidably received in said chamber of said housing for engaging with a work piece, a base including a first end secured to said barrel and including an orifice formed in said first end of said base and aligned with said driving tool for allowing said driving tool to be engaged through said orifice of said base, said base including a groove formed therein for slidably receiving fasteners to be engaged into the work piece, a latch engaged into said barrel and engaged with said first end of said base for securing said first end of said base to said barrel, said latch including a pair of protrusions extended therefrom and a slit defined between said protrusions of said latch for slidably receiving and guiding the fasteners, a casing including a space formed therein for slidably receiving said base and for slidably engaging said casing onto said base, said casing including a passageway formed therein for slidably receiving the fasteners, means for moving the fasteners into said barrel, a biasing means received in said chamber of said housing and engaged with said barrel and said base for applying a biasing force against said barrel and said base when said barrel and said first end of said base are forced inward of said housing, means for moving said casing away from said barrel when said barrel moves inward of said housing, said casing moving means including at least one cam surface formed in said housing, said casing including a rod engaged with said cam surface for moving said casing away from said barrel when said barrel moves inward of said housing, and means for securing said rod to said casing.

12. The stapler according to claim 11 further comprising a block secured to said first end of said base, said block including an arm extended therefrom and having a groove formed in said arm, said rod securing means includes a coupler slidably received in said groove of said arm for slidably guiding said casing to move along said arm.

* * * * *